United States Patent [19]

Ankers et al.

[11] Patent Number: 4,941,850

[45] Date of Patent: Jul. 17, 1990

[54] SHIELDED CABLE CONNECTOR

[76] Inventors: Malcolm D. Ankers, 64 Mount Avenue, Worksop, Notts., S81 7JL.; Roy E. Weston, 144 Stanton Road, Sandiacre, Notts., NG10 5EP, both of England

[21] Appl. No.: 301,812

[22] Filed: Jan. 25, 1989

[30] Foreign Application Priority Data

Feb. 8, 1988 [GB] United Kingdom ..... 8802801

[51] Int. Cl.[5] ..... H01R 13/648; H01R 43/04

[52] U.S. Cl. ..... 439/610; 29/858; 29/861; 439/585

[58] Field of Search ..... 439/607, 608, 610, 585, 439/98, 675; 29/858, 859, 861, 862

[56] References Cited

U.S. PATENT DOCUMENTS 4,634,208 1/1987 Hall et al. ..... 439/610

FOREIGN PATENT DOCUMENTS 62760 10/1982 European Pat. Off. ..... 439/585

*Primary Examiner*—Steven C. Bishop

*Attorney, Agent, or Firm*—Neuman, Williams Anderson & Olson

[57] ABSTRACT

The present invention provides a connector having a seamless tubular metallic shell which not only provides proper RFI/EMC shielding but also is constructed in such a way as to prevent ingress of moulding material into the spaces between contacts of the connector. This is achieved by forming one end of a seamless tube of ferromagnetic material (which is initially of substantially uniform cross-sectional area) such that is collapsed on to itself and a cable connected to the connector whereby to tightly seal the send of the tube on to the cable to prevent ingress of moulding material subsequently applied to the exterior of the shell. In the case of a cable providing a braid or foil shielding element, this process simultaneously provides an electrical bond between the shell and a portion of the shielding element of the cable exposed by removing a portion of the outer insulation covering of the cable.

6 Claims, 1 Drawing Sheet

SHIELDED CABLE CONNECTOR

The present invention relates to a shielded cable connector and to a method of producing such a connector.

In many cable connector constructions it is customary to provide a metallic shell which contains a body of insulating material provided with either pins or socket contacts. One such connector is a so-called DIN plug which is of generally cylindrical form.

It is known that the metallic shell has not only mechanical properties but also electrical properties in that the shell, if properly constructed can provide Radio Frequency Interference/Electro-Magnetic Compatibility (RFI/EMC) shielding. This normally implies that the metallic shell should be of a ferromagnetic material and be continuous around the circumference of the plug. However, in order to keep costs to a minimum it has become customary to form the metallic shell, particularly for mini-DIN plugs, by rolling a flat blank which thus forms a seamed shell the shell being formed into its final shape (with tapering and/or flared portions) before the plug is assembled. Where RFI/EMC shielding is important this seam has heretofore been soldered to provide effective electrical continuity across the seam.

A further problem occurs in the production of connectors. It is customary to over-mould the metallic shell with a plastic material such as PVC after the connector has been attached to the end of a cable. This usually results in molding material entering into the spaces between the contacts in the body of insulating material. This ingress of molding material is often unacceptable as it alters the theoretical insulating characteristics between contacts.

In the prior art, different methods of attaching the metallic shell to the cable and insulating body of a cable connector have been utilised, and shells of various preformed shapes have been employed. In the invention disclosed in GB Pat. No. 1,073,899 it is necessary to use a spiral indent type mechanical crimp between tapering and flaring portions of the metallic shell in order to prevent destruction or opening of the seam. However, such a spiral indent type crimp is not able to prevent the ingress of plastic material during a subsequent over-moulding process. In the disclosure of U.S. Pat. No. 3,992,773, a shell with alternate cylindrical and tapering portions is used and a method is given of attaching the metal shell to the insulating body by screw thread or the like, with a tight seal for the prevention of ingress of water obtained by magnetically deforming the shell into the valleys of the depressions on the serrated surface of the insulating body. The attachment and sealing of the metal shell to the cable is effected by a similar magnetic crimping method.

The present invention provides a connector having a seamless tubular metallic shell which not only provides proper RFI/EMC shielding but also is constructed in such a way as to prevent ingress of moulding material into the spaces between contacts of the connector. This is achieved by forming one end of a seamless tube of ferromagnetic material (which is initially of substantially uniform cross-sectional area) such that it is collapsed on to itself and a cable connected to the connector whereby to tightly seal the end of the tube on to the cable to prevent ingress of moulding material subsequently applied to the exterior of the shell. In the case of a cable providing a braid or foil shielding element, this process simultaneously provides an electrical bond between the shell and a portion of the shielding element of the cable exposed by removing a portion of the outer insulation covering of the cable.

Preferably a reduction in diameter of a portion at the end of the tube to the diameter of the cable is effected by mechanically crimping the end portion to produce a number of radially projecting fins from folds in the tube arising from the crimping process such that the fins do not project beyond the original outer diameter of the tube, but such that an elongation of the tube may result. This crimping process both produces a seal which prevent ingress of over-moulding material and is of such a type as to facilitate the use of a seamless metallic tube.

An additional advantage of the above construction is that the crimped end of the tube also acts as a strain relief cable clamp.

Further features and advantages of the present invention will become apparent from the following description of an embodiment thereof given by way of example when taken in conjunction with the accompanying drawings, in which.

A preferred embodiment of the present invention will be described in relation to the construction of a DIN plug and more particularly a miniDIN plug which is one of smaller diameter than the customary DIN plug.

Figure 1:
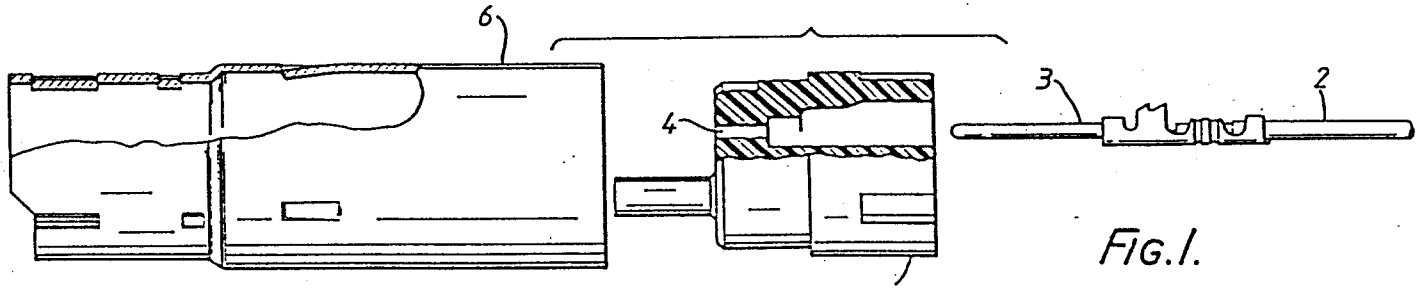
FIG. 1 shows an exploded side view of a connector and cable arrangement prior to assembly with parts broken away for clarity.

Referring now to FIG. 1, this shows the basic constructional elements of a shielded cable connector attached to a cable. The cable 1 comprises a number of insulated wires 2 only one of which is shown in FIG. 1. The end of the wire 2 is attached to a connector pin 3 in any convenient manner such as crimping or soldering. The pin 3 is inserted into a bore 4 in a cylindrical body 5 of insulating material. A sleeve 6 of ferromagnetic material is then slipped over the exterior of the insulating body 5 and constitutes the usual metal shell of the DIN plug. The assembly is then over-moulded with an insulating material such as PVC.

Figure 2:
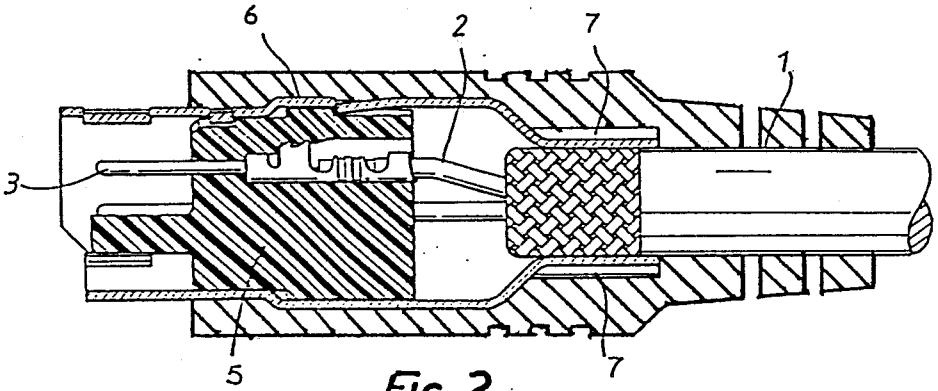
FIG. 2 shows a side view of an assembled connector and cable.
Figure 3:
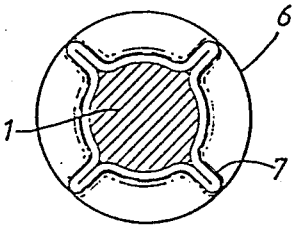
FIG. 3 shows an end view of the assembly shown in FIG. 2.

Thus far the method of construction is conventional but the construction according to the present invention differs to previous construction in so far as the sleeve 6 is formed from a seamless tube of ferromagnetic material (usually soft steel of low carbon content) which is of substantially uniform cross-sectional area. Further, in the present invention the end of the sleeve 6 is deformed in the region of the cable 1 in order to reduce the diameter of the bore of the sleeve from a diameter approximately equal to the outside diameter of the body 5 to a diameter of the order of the diameter of the cable 1. This is done by mechanically crimping the end of the sleeve 6 in the region of the cable 1 to form the shell as shown in FIGS. 2 and 3. In order to achieve the formation of the sleeve as shown in FIGS. 2 and 3, the assembled connector is inserted into a multiple segment tool e.g. a four segment tool, the radii and curvature of each of the segments having been carefully designed to crimp a portion at the end of the metal sleeve into a number of fins, in this case four, and produce a resultant bore for this portion of the sleeve which is slightly smaller than the nominal outside diameter of the cable 1. The crimping process is such that the fins produced do not project beyond the original outer diameter of the sleeve 6 and a fractional elongation of the sleeve 6 may result. The design of the tool segments is such that the fins formed by the crimping are tightly closed and the formation of the portion of the sleeve 6 with reduced diameter bore is also carefully controlled so that the cable is tightly clamped by the crimped end section.

The design of the tool segments is such as to tightly close the fins formed by the crimping operation but without splitting the shell material and to close down the end of the sleeve 6 tightly on to the surface of the cable 1 so as to form a tight seal to prevent ingress of moulding material which is subsequently applied to the outside of the shell and cable assembly. A consequent advantage of the closing down of the end of the sleeve 6 on to the cable is that the crimping operation automatically produces a strain relief cable clamp. Additionally, the crimping operation may provide an electrical bond between the sleeve 6 and the shielding element (e.g. braid or foil) of the cable 1, whereupon the application of over-moulding material to the connector may not be required.

It will be appreciated that the sleeve 6 can be formed with the usual indentations and or slots which are customarily provided in these sleeves of DIN plugs by a pre-formation of the sleeve before assembling.

The number and/or disposition of the contacts and bores can be altered to suit any desired specification.

We claim:

1. A cable connector construction comprising a body of insulating material provided with a number of bores each receiving an electrical contact attached to an end of an insulated electrical conductor extending from a cable; a seamless tube of ferromagnetic material of substantially uniform cross-sectional area which receives the body within its bore with the cable extending from one end of the tube, said one end of the tube being collapsed on to itself and directly on to the cable surface so as to form a plurality of radial fins whereby to form a seal at said one end of the tube between the inner periphery of the tube and the outer periphery of the cable.

2. A cable connector construction according to claim 1, and comprising a layer of insulating material on the outside of the tube and conductors in the area of said one end of the tube.

3. The cable connector construction according to claim 1 in combination with a cable having an outer layer of insulating material overlying a conductive sheath; said sheath overlying said insulated electrical conductor; said seamless tube one end being uniformly collapsed on to itself into gripping engagement with both a portion of said sheath uncovered by said insulation covering and said insulation covering.

4. A method of constructing a shielded cable connector comprising attaching an electrical contact to a free end of each of a number of insulated electrical conductors extending from a cable, inserting the electrical contacts in respective bores through a body of insulating material, inserting the body into the bore of a seamless tube of ferromagnetic material of substantially uniform cross-section with the cable extending from one end of the tube, and collapsing said one end of the tube on to itself and directly on to the cable whereby to seal said one end of the tube.

5. A method according to claim 4, wherein the step of collapsing of the tube is achieved by crimping the end of the tube into fins arranged at spaced intervals about the tube periphery within the tube cross-sectional area.

6. The method according to claim 4 in which the cable has an outer layer of insulating material overlying a conductive sheath, and collapsing of said one end of said tube occurs in a step which simultaneously urges said tube into engagement with both said sheath and said insulating material, and said seal is adequate to prevent entrance of a plastic material applied in the course of over molding the tube end.

* * * * *